United States Patent [19]

Koerschner et al.

[11] Patent Number: 4,651,507

[45] Date of Patent: Mar. 24, 1987

[54] TIE-OFF CLOSURE METHOD FOR NETTING PRODUCTS

[75] Inventors: Lou A. Koerschner, White Bear Lake; Robert C. Sloumb, Shoreview; William E. Weber, Vadnais Heights, all of Minn.

[73] Assignee: Leucadia, Inc., New York, N.Y.

[21] Appl. No.: 760,090

[22] Filed: Jul. 29, 1985

Related U.S. Application Data

[62] Division of Ser. No. 491,179, May 2, 1983, Pat. No. 4,571,779.

[51] Int. Cl.[4] ..... B65B 11/00; B65B 49/00; B23P 11/02

[52] U.S. Cl. ..... 53/461; 29/446; 140/93.4; 206/442

[58] Field of Search ..... 29/446, 452, 453, 526 R; 206/597, 442, 83.5; 24/30.5 S, DIG. 28, 545, 563, 571; 53/461; 140/93.4, 93.2

[56] References Cited

U.S. PATENT DOCUMENTS

| | | | |
|---|---|---|---|
| 3,541,660 | 11/1970 | Soto | 29/453 X |
| 3,665,979 | 5/1972 | Neale, Sr. | 140/93.4 |
| 3,822,441 | 7/1974 | Paxton | 24/30.5 S |
| 3,962,757 | 6/1976 | Gedney | 24/30.5 S X |
| 4,100,717 | 7/1978 | Kontinen | 29/453 X |
| 4,136,501 | 1/1979 | Connolly | 53/461 |

*Primary Examiner*—Charlie T. Moon
*Attorney, Agent, or Firm*—Vidas & Arrett

[57] ABSTRACT

A tie-off closure method for securing wrapped plastic netting around a load on a pallet or the like.

6 Claims, 6 Drawing Figures

TIE-OFF CLOSURE METHOD FOR NETTING PRODUCTS

This is a division, of application Ser. No. 491,179, filed May 2, 1983, now U.S. Pat. No. 4,571,779.

The invention relates to a method and device for firmly securing an end of a netting product to another portion of the netting product and it particularly relates to a method and device for tying off the end of a net product which has been wrapped under tension around a load, for example, cases, crates, or bags on pallets for load unitization.

Netting products are becoming more and more sought after as means for palletizng and securing packaged products. However, heretofore there has always been a major problem as to how the pallet net wrap could be secured after cutoff so as to maintain the tension on the net wrap. The problem does not occur to a similar extent with the known film wraps simply because the film tends to cling to itself so as to continue to maintain the tension.

Many methods of tying of the pallet wrap have been suggested and actually used with the net wraps. The simplest method for securing the end of the net wrap is to tuck it under one of the previous wraps. It will be appreciated that in most cases, however, the force holding the end in place is not sufficient to prevent the load from slipping or to prevent loss of tension in the wrap. This loss of tension may be overcome by tying a knot in the end to prevent its slipping from under the wrap or simply by tying it in some way to the previously wrapped layers or to the pallet. In such cases, it is relatively easy to lose all tension since the close-off end is free and it will be appreciated that such close-off methods become quite labor-intensive and are not simple matters, particularly where high-tension wrapping must be maintained.

Other suggested methods where a pallet is used are to staple the end of the net to the pallet or to use a hog ring for tying off the ends of the net. These methods have some fairly major drawbacks in that the possibility of metal pieces in the net considerably reduces the ease with which the net may be recycled and the hog ring in particular, requires hog ring pliers or a hog ring gun for fastening the end. The hog ring and staples also may not work effectively since they have a distressing tendency to cut the strands of the plastic net.

In accordance with the present invention, a plastic clip is provided for holding the strands of netting at the end of the wrap to the strands of a previous wrap. The clip comprises a strip of plastic having a slot which opens at one end of the strip and extends into a mid-portion of the strip. A plurality of slits or notches formed in the strip branch angularly away from the slot and preferably extend toward the end of the strip having the opening so that the joints along the strands of netting passing through the slot will engage with these slits and will thereby keep the strands of netting from slipping out of the clip.

The clip can be used to tie off the netting while the netting is still on the wrapping machine so that tension is easily maintained.

In accordance with the inventive method, with tension on the net, the net leading from the roll of netting on the machine to the load is necked down, suitably by a worker's simply grasping it in one hand, and all of the strands of the netting are forced into the slot of the clip which is then clipped to the strands of net of a previous wrap. With the clip in place, the netting from the roll is cut at a spaced distance from the clip to free it from the roll.

It will be appreciated that the major advantage of the method and device in accordance with the invention is that by a relatively simple method and an easily manufactured device, the net may be easily tied off in seconds while the wrapped load remains under tension. The clip is preferably manufactured from polystyrene and therefore is compatible with the recycling of the plastic net product. It is particularly useful in conjunction with the prestretched linear low-density polyethylene netting sold by Conwed Corp. under the Trademark TENSIONET and also with polypropylene netting.

Further features and advantages of the method and device in accordance with the invention will be evident from the description of the figures wherein.

Figure 1A:
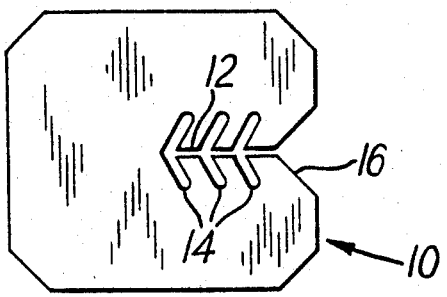
FIG. 1 is a clip in accordance with the invention.
Figure 1B:
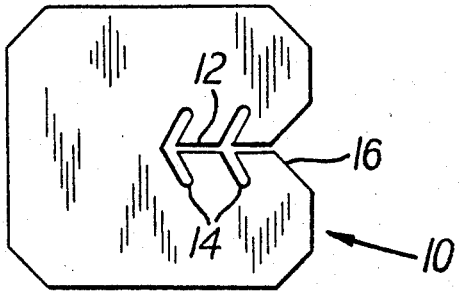

FIG. 1 is a drawing of the clip in accordance with the invention. The clip 10 is a strip of plastic of any convenient length and width, suitably square or nearly square, and of about 1 inch in length. Preferably, the clip is manufactured from 0.08 inch polystyrene, though other suitable materials are also well known in the art and, of course, may be used if desired. The only requirements are that the material be of suitable stiffness and be compatible with the plastic net product with which the clip is to be used if recycling of the net product is desirable.

At one end of the clip 10, a slot 12 is formed, which slot extends to the mid portion of the strip. Slits 14 open into the slot 12 and extend outwardly and toward the opening so as to form branches off the slot 12 for engaging strands of plastic netting. The actual numbers of the slits or branches is relatively unimportant so long as the slot 12 is sufficiently deep and the slits 14 are of proper dimension to receive the strands of netting and to prevent the joints of the netting from passing through as further described in the method below. Preferably, there are at least two pairs of spaced symmetric branches 14, but it will be appreciated that non symmetric pairs may also be utilized.

While not required, there is also preferably a V-notch 16 formed at the opening of slot 12 so that strands of netting are easily channeled into the opening of slot 12 as the net strands are being engaged.

Figure 2A:
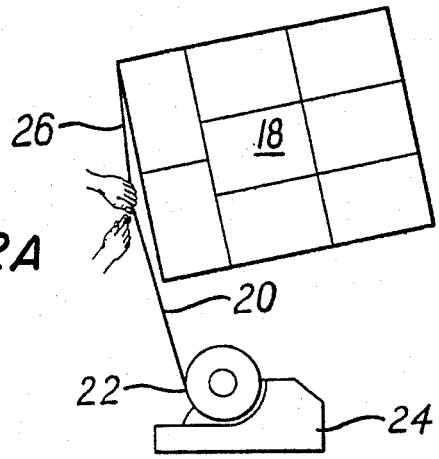
FIG. 2A shows schematically a load and load wrapping machine at the final wrap.

The steps of the method in accordance with the invention are illustrated in FIGS. 2A through 2D. FIG. 2A illustrates schematically a wrapping machine and a wrapped load. As illustrated a load 18, for example, a palletized stack of bags is wrapped with netting 20 from a roll 22 in wrapping machine 24. It is assumed that the netting has been wrapped about the palletized load in conventional manner as is well known in the art and that the machine has completed the final wrap so that the only step left is to tie off the end of the net coming from the roller.

Figure 2B:
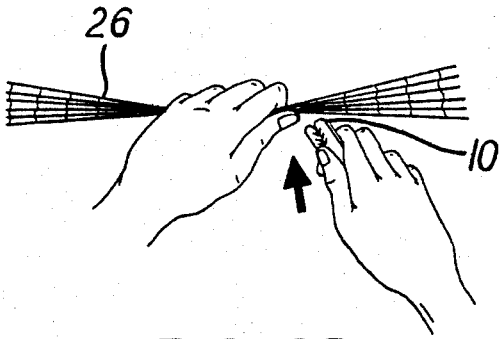
FIG. 2B shows a schematic detail of engaging the net from the roll with the clip.

The last revolution of the turn-table of machine 24 should leave the portion 26 of netting 20 between the roll 22 and the load 18 almost flush with a side of the load. In this condition and with the tension still on, a worker grasps the netting portion 26 with one hand as best seen in FIG. 2B. With his free hand, the worker grasps the clip 10 and feeds the strands of the netting into the notch 16 and works all of the strands into the various branched slits 14 of the slot 12.

Figure 2C:
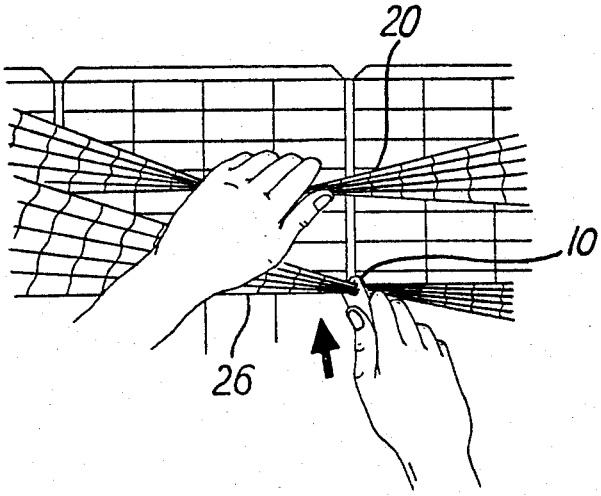
FIG. 2C shows the affixing of the net to the wrapped load.
Figure 2D:
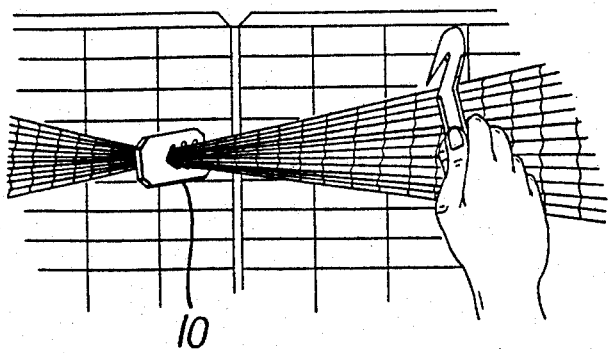
FIG. 2D illustrates the cutting of the net from the roll to free the load.

The next step is illustrated in FIG. 2C. The worker grasps a plurality, preferably about 6, of strands of netting 20, from a previous wrap at a position just behind the already clipped net portion 26. The strands of net from this previous wrap are then combined in the clip with the engaged net strands already in the clip. It is preferable that the sections be clipped together just to the left of the vertical strands, as illustrated in FIG. 2D.

The net is then cut by the worker using any conventional cutting tool, preferably at a point approximately 8–10" from the clip 10. When the machine tension has been set appropriately, after the netting is cut, the clip will snap back to the load and will be held securely against the side of the load, the clip slot 12 and branches 14 being too small to let the joints of the netting slip through.

Thus, there has been provided a simple method and device for tying-off a net product which enables a quick tie-off with tension still being maintained, which further requires no tools, no extensive capital investment for tooling and which introduces no metal into the net itself.

It will be understood that the claims are intended to cover all changes and a modifications of the preferred embodiments of the invention, herein chosen for the purpose of illustration, which do not constitute departures from the scope and spirit of the invention.

What is claimed is:

1. A method for securing an end piece of wrapping netting material of the type used for load unitization when wrapping is completed, said net having a plurality of strands, comprising the steps of:

(a) maintaining a predetermined tension on said endpiece while holding it substantially adjacent a previous wrap of the netting;

(b) engaging all the strands of the netting of said endpiece in a relatively stiff plastic clip, said clip having a plurality of slits operative for engaging the strands of said endpiece and preventing passage of joints in the netting therethrough;

(c) combining a portion of the strands of the previous wrap of netting with those strands of the endpiece by clipping said portion of strands into said clip; and (d) cutting the strands of said endpiece at a spaced distance from said clip, whereby the clip holding said strands of said endpiece is held adjacent said previous wrap by the tension of strands within the clip.

2. The method of claim 1 wherein the clip is a polystyrene plastic clip.

3. The method of claim 1 wherein the tension is maintained in a wrapping machine.

4. The method of claim 1 wherein the netting is a linear low-density polyethylene netting.

5. The method of claim 1 wherein the netting is a polypropylene netting.

6. A method for securing the netting of a wrapped untized load at the completion of wrapping the load, the load being wrapped by use of a load wrapping machine, comprising the steps of:

(a) maintaining predetermined tension on the netting while holding the last wrap immediately adjacent an earlier wrap along the side of the load;

(b) engaging all of the strands of the last wrap of the netting in a relatively stiff clip operative to hold the strands;

(c) subsequently engaging a plurality of strands of the earlier wrap in said clip whereby said clip engaging said strands is held affixed to the netting wrap wrapping said load; and (d) cutting said last wrap whereby a free end is left beyond the clip, said clip being held in position by the tension in said netting about said load.

* * * * *